US007688265B2

(12) United States Patent
Irion, II et al.

(10) Patent No.: US 7,688,265 B2
(45) Date of Patent: Mar. 30, 2010

(54) DUAL POLARIZED LOW PROFILE ANTENNA

(75) Inventors: James M. Irion, II, Allen, TX (US); Robert S. Isom, Allen, TX (US)

(73) Assignee: Raytheon Company, Waltham, MA (US)

( * ) Notice: Subject to any disclaimer, the term of this patent is extended or adjusted under 35 U.S.C. 154(b) by 38 days.

(21) Appl. No.: 11/857,279

(22) Filed: Sep. 18, 2007

(65) Prior Publication Data

US 2009/0073075 A1 Mar. 19, 2009

(51) Int. Cl.
*H01Q 1/38* (2006.01)

(52) U.S. Cl. ..... 343/700 MS; 343/797

(58) Field of Classification Search ..... 343/700 MS, 343/793, 795, 797, 846, 859, 820, 821, 822
See application file for complete search history.

(56) References Cited

U.S. PATENT DOCUMENTS

| | | | | |
|---|---|---|---|---|
| 3,740,754 | A | 6/1973 | Epis | |
| 3,976,959 | A | 8/1976 | Gaspari | 333/26 |
| 5,594,455 | A | 1/1997 | Hori et al. | 343/700 |
| 5,874,924 | A | 2/1999 | Csongor et al. | |
| 6,024,812 | A * | 2/2000 | Bley et al. | 149/92 |
| 6,114,997 | A * | 9/2000 | Lee et al. | 343/700 MS |
| 6,300,906 | B1 * | 10/2001 | Rawnick et al. | 343/700 MS |
| 2005/0219008 | A1 | 10/2005 | De Flaviis | 333/26 |
| 2006/0232489 | A1 * | 10/2006 | Bisiules et al. | 343/797 |
| 2006/0279471 | A1 * | 12/2006 | Zimmerman | 343/818 |

FOREIGN PATENT DOCUMENTS

| | | | |
|---|---|---|---|
| DE | 20 2004 008 770 | U1 | 9/2004 |
| EP | 0 323 664 | A2 | 7/1989 |
| EP | 1 367 672 | A1 | 3/2003 |
| EP | 1 879 256 | A1 | 1/2008 |
| GB | 22 424 765 | A | 4/2006 |
| JP | 62216502 | | 9/1987 |
| WO | WO 01/31735 | A1 | 5/2001 |
| WO | WO 2006/114455 | A1 | 2/2006 |

OTHER PUBLICATIONS

PCT Notification of Transmittal of the International Search Report and the Written Opinion of the International Searching Authority, or the Declaration, mailed Nov. 6, 2008, in re PCT/US2008/073623 filed Aug. 20, 2008 (19 pages).

(Continued)

*Primary Examiner*—HoangAnh T Le
(74) *Attorney, Agent, or Firm*—Baker Botts L.L.P.

(57) ABSTRACT

In one embodiment of the disclosure, a dual polarized antenna includes first and second active elements and at least one parasitic element disposed a predetermined distance from the first and second active elements. Circuitry is coupled to the first and second active elements and operable to generate electro-magnetic energy from the first and second active elements along a direction of propagation. The first active element having a direction of polarization that is different than a direction of polarization of the second active element.

19 Claims, 6 Drawing Sheets

OTHER PUBLICATIONS

European Search Report; for Application No. 08006242.5-2220; 8 pages, Jul. 10, 2008.
I-Jen Chen, "CPW-Fed Circularly Polarized 2×2 Sequentially Rotated Patch Antenna Array," Microwave Conference Proceedings, 2005, IEEE, vol. 4, pp. 1-3, XP010902322, Dec. 4, 2005.
Guang-Jong Chou et al, "Oscillator-Type Active-Integrated Antenna: The Leaky-Mode Approach," 19961201, vol. 44, No. 12, 8 pages, IEEE, Dec. 1, 1996.
U.S. Appl. No. 11/734,517, filed Apr. 12, 2007, entitled "Low Profile Antenna," 23 pages.

* cited by examiner

DUAL POLARIZED LOW PROFILE ANTENNA

TECHNICAL FIELD OF THE DISCLOSURE

This disclosure generally relates to antennas, and more particularly, to a dual polarized low profile antenna and a method of constructing the same.

OVERVIEW OF THE DISCLOSURE

Electro-magnetic radiation at microwave frequencies has relatively distinct polarization characteristics. Microwave radio communications utilize a portion of the electro-magnetic spectrum that typically extends from the short-wave frequencies to near infrared frequencies. At these frequencies, multiple electro-magnetic signals having a similar frequency may be independently selected or tuned from one another based upon their polarity. Therefore, microwave antennas have been implemented having the capability of receiving and/or transmitting signals having a particular polarity, such as horizontal, vertical, or circular polarity.

SUMMARY OF THE DISCLOSURE

In one embodiment of the disclosure, a dual polarized antenna includes first and second active elements and at least one parasitic element disposed a predetermined distance from the first and second active elements. Circuitry is coupled to the first and second active elements and operable to generate electro-magnetic energy from the first and second active elements along a direction of propagation. The first active element has a direction of polarization that is different than a direction of polarization of the second active element.

In another embodiment, a method of constructing a dual polarized antenna includes providing an antenna according to the teachings of the disclosure, determining the desired operating parameters of the dual polarized antenna, and matching the impedance of a first and second active elements of the dual polarized antenna to free space.

Certain embodiments may provide numerous technical advantages. A technical advantage of one embodiment may be to provide a dual polarized antenna having a relatively low depth profile. While other prior art dual polarized antenna implementations incorporating active elements such as notch antennas have enjoyed relatively wide acceptance, they require a depth profile that is generally at least a ¼ wavelength at the lowest frequency of operation. Certain embodiments of the disclosure may provide operating characteristics that are comparable to and yet have a depth profile significantly less than notch antenna designs.

Although specific advantages have been enumerated above, various embodiments may include all, some, or none of the enumerated advantages. Additionally, other technical advantages may become readily apparent to one of ordinary skill in the art after review of the following figures and description.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS OF THE DISCLOSURE

While dual polarized antennas may have numerous advantages, known implementations of these devices require a relatively large depth profile, thus limiting their usage is some applications. For example, dual polarized antennas implemented with notch elements have gained a wide acceptance due to their generally good operating characteristics. However, these notch antenna elements require a depth profile that is at least approximately ¼ wavelength at the lowest desired operating frequency. For applications, such as cellular telephones or other small communication devices, this limitation may be prohibit the use of dual polarized antennas utilizing notch elements.

Figure 1A:
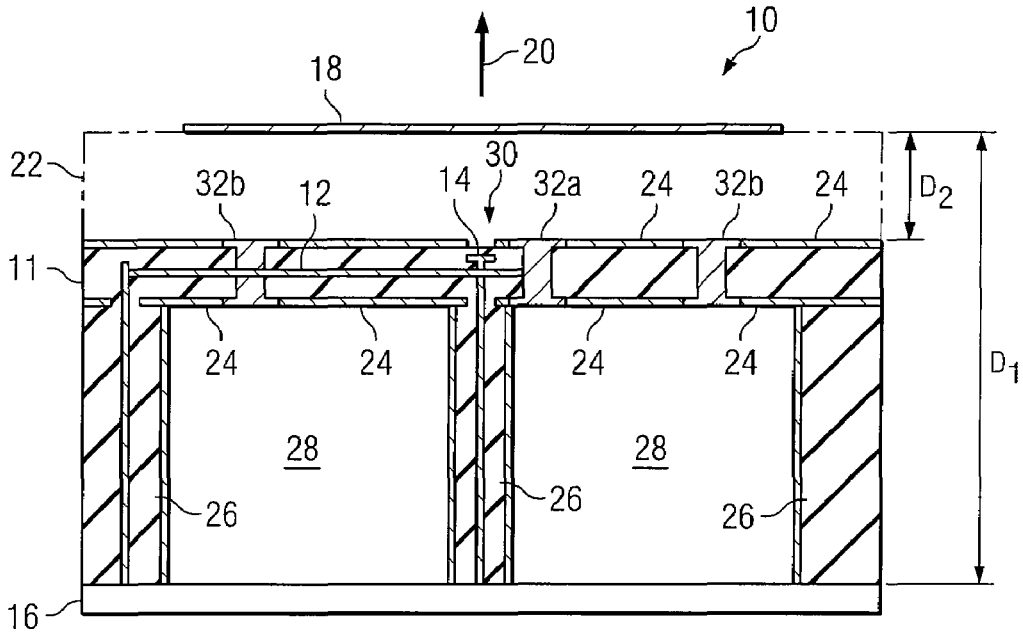
FIG. 1A is a side elevation, cross-sectional view of one embodiment of a dual polarized low profile antenna according to the teachings of the present disclosure.

FIG. 1A shows one embodiment of a dual polarized low profile antenna 10 that may provide enhanced characteristics over previously known implementations. In this particular embodiment, various elements of the dual polarized low profile antenna 10 are formed on various layers of a multi-layer printed circuit board (PCB) 11. The dual polarized low profile antenna 10 generally includes a first 12 and second 14 active elements that are each disposed between a pair of circuit board ground planes 24. This arrangement provides for generation of an electro-magnetic wave having a direction of propagation 20 upon excitation of first 12 and second 14 active elements by an electrical signal. As will be described in greater detail below, dual polarized low profile antenna 10 may have a shorter depth profile $D_1$ than other known dual polarized antenna designs.

In one embodiment, the first 12 and second 14 active elements are each strip-lines that extend between the center conductor of an unbalanced line and a via 32*a*. Unbalanced transmission line 26 may be any suitable transmission line for the transmission of electrical signals, such as coaxial cable, unbalanced t-line feed, stripline, or a microstrip line. The via 32*a* is electrically connected to both circuit board ground planes 24 configured on either side of the active elements 12 and 14. A number of other vias 32*b* may be configured on various locations to maintain relatively good electrical coupling to the circuit board ground planes 24 to one another. The outer conductor of the unbalanced transmission line 26 may be electrically connected to one of the circuit board ground planes 24.

A cavity 28 may be formed between the multi-layer printed circuit board 11 and main ground plane 16. In one embodiment, first active element 12 and second active element 14 may extend across each other through a gap region 30.

Ground planes 16 and 24 in conjunction with the cavity 28 forms a type of circuitry for coupling of first 12 and second 14 active elements to the gap region 30. The gap region 30 is formed of a discontinuity between the circuit board ground planes 24 and may be operable to emit electro-magnetic radiation as described in detail below.

Parasitic element 18 is disposed a predetermined distance D2 from first 12 and second 14 active elements by a dielectric layer 22. The parasitic element 18 may be disposed generally normal to the direction of propagation 20. Parasitic element 18 may be used to match the impedance of the first 12 and second 14 active elements to free space. It is known that relatively efficient coupling of an antenna to free space occurs when the output impedance of the antenna is approximately 377 ohms, the characteristic impedance of free space. To accomplish this, particular physical characteristics of the parasitic element 18 or dielectric layer 22 may be selected in order to manipulate the output impedance of the dual polarized low profile antenna 10. In one embodiment, a size or shape of the parasitic element 18 may be selected in order to manipulate the output impedance of the dual polarized low profile antenna 10. In another embodiment, the dielectric layer 22 may be selected to have a predetermined depth $D_2$. In another embodiment, dielectric layer 22 formed of a particular material having a known dielectric constant may be further utilized to manipulate the impedance of the dual polarized low profile antenna 10. In another embodiment, the depth of the cavity 28 may be selected to manipulate the impedance of the dual polarized low profile antenna 10. In yet another embodiment, multiple parasitic elements 18 may be stacked, one upon another and generally normal to the direction of propagation 20 in order to further manipulate the output impedance and thus the operating characteristics of the dual polarized low profile antenna 10.

Certain embodiments of the disclosure may provide a dual polarized low profile antenna 10 having a relatively shorter depth profile $D_1$ than other known dual polarized antenna implementations while maintaining relatively similar performance characteristics, such as bandwidth and scan performance. Other antenna designs such as patch antennas may provide a relatively low depth profile, yet may not provide the performance characteristics available with the dual polarized low profile antenna 10. That is, the dual polarized low profile antenna 10 may provide a depth profile comparable to patch antennas with performance characteristic comparable to notch antennas in certain embodiments.

In one embodiment, the shorter depth profile may provide for implementation with various communication devices where the overall depth of the antenna may be limited. Additionally, various physical features of the parasitic element 18 or dielectric layer 22 may be customized as described above to tailor the operating characteristics of the dual polarized low profile antenna 10.

Figure 1B:
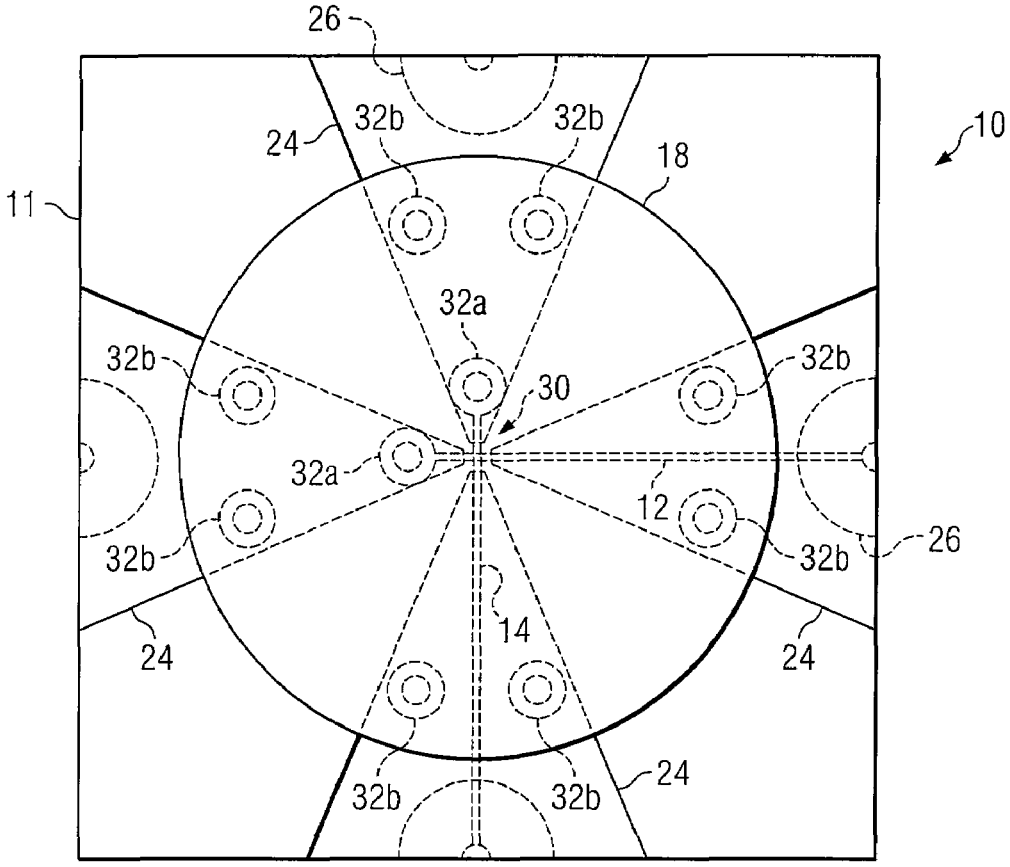
FIG. 1B is plan view of the dual polarized low profile antenna of FIG. 1A.

FIG. 1B is a plan view of the dual polarized low profile antenna 10 of FIG. 1A showing details of the first 12 and second 14 active elements and circuit board ground planes 24. In one embodiment, first active element 12 and second active element 14 may extend across each other through the gap region 30. Upon excitation of the first 12 and second 14 active elements by unbalanced transmission lines 26, electro-magnetic radiation may be emitted through the gap region 30. Because the first 12 and second 14 active elements are operable to generate electro-magnetic radiation from a common location, the dual polarized low profile antenna 10 may be referred to as a co-located phase center type dual polarized radiator.

As shown, the parasitic element 18 has a circular shape. It may appreciated however, that parasitic element 18 may have any shape or size that generally matches the impedance of first 12 and second 14 active elements to free space. Additionally, any suitable number of parasitic elements 18 may be utilized. Although only one parasitic element 18 is shown in the drawings, the dual polarized low profile antenna 10 may utilize one or more parasitic elements 18 in order to further tailor its operating characteristics.

In one embodiment, first active element 12 is generally orthogonal to second active element 14. Thus, electro-magnetic energy radiated from first 12 and second 14 active elements may share a common axis proximate this gap region 30. The gap region 30 provides a common region where electrical signals provided to first 12 and second 14 active elements may be combined at various phases or amplitudes relative to one another in order to form a resulting electro-magnetic wave having virtually any desirable scan angle.

Vias 32 may be provided to facilitate attachment of first 12 and second 14 active elements to circuit board ground plane 24. The distance of the vias 32 from the gap region 30 may be chosen to further tailor various operating characteristics of the dual polarized low profile antenna 10. For example, the distance of the vias 32 to the gap region 30 may be operable to manipulate the symmetry of the resulting electro-magnetic wave produced by the dual polarized low profile antenna 10. In one embodiment, vias 32 may be proximate to gap region 30 as shown in FIG. 1B. In this manner, the dual polarized low profile antenna 10 may be operable to produce an electro-magnetic wave having relatively good symmetry.

Figure 1C:
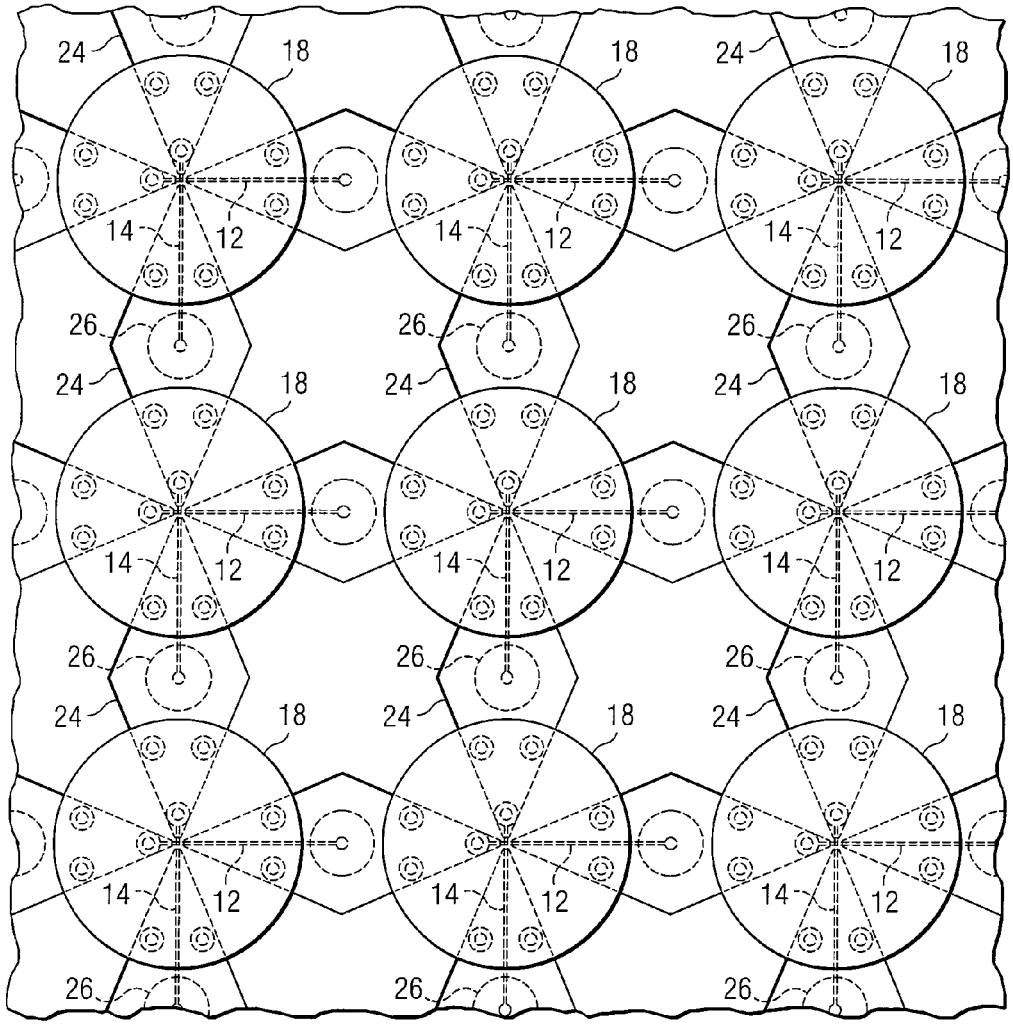
FIG. 1C is a plan view of a number of dual polarized low profile antennas of FIG. 1A that may be configured together in order to form an array.

FIG. 1C is a plan view of an array of dual polarized low profile antennas 10 that may be configured together. In this particular embodiment, the dual polarized low profile antennas 10 may be fabricated on a single multi-layer printed circuit board 11. The first 12 and second 14 active elements comprising the array of dual polarized low profile antennas 10 may each be independently driven by unbalanced transmission lines 26. Electro-magnetic signals produced by each of the multiple dual polarized low profile antennas 10 may combined in order to form a resultant electro-magnetic signal having any selectable scan angle.

Figure 2A:
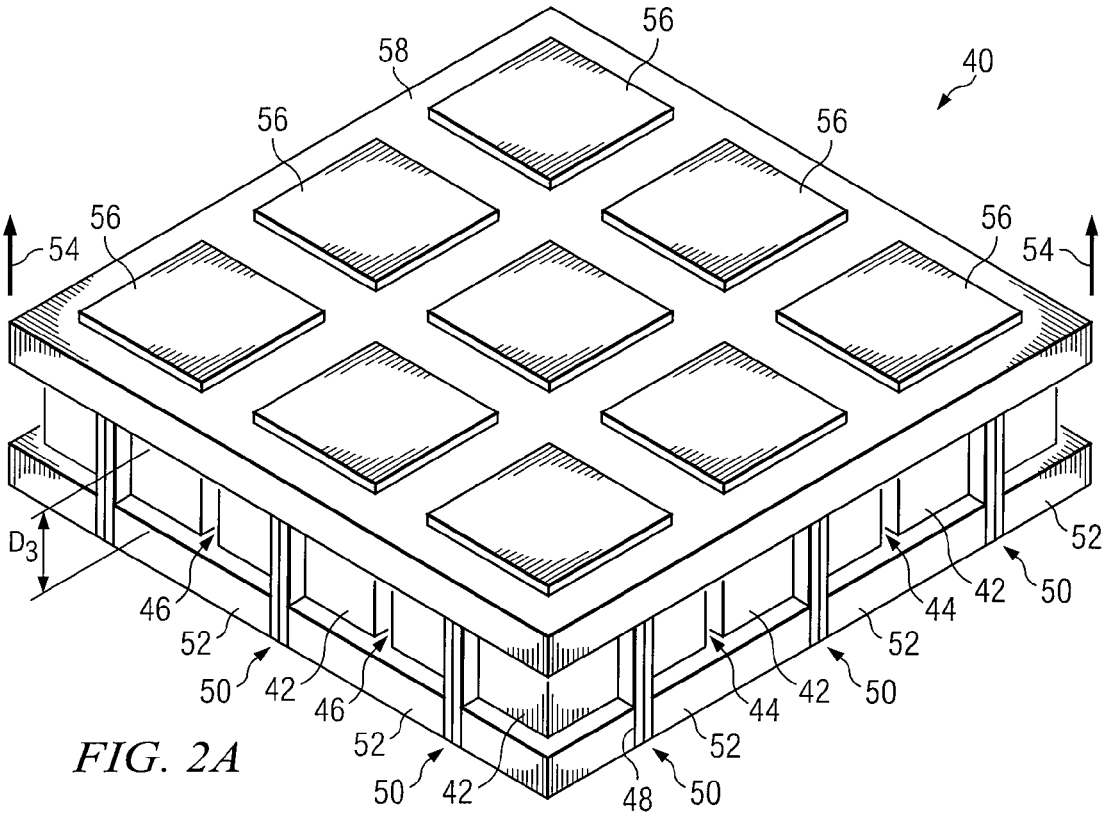
FIG. 2A is a perspective view of another embodiment according to the teachings of the disclosure.
Figure 2B:
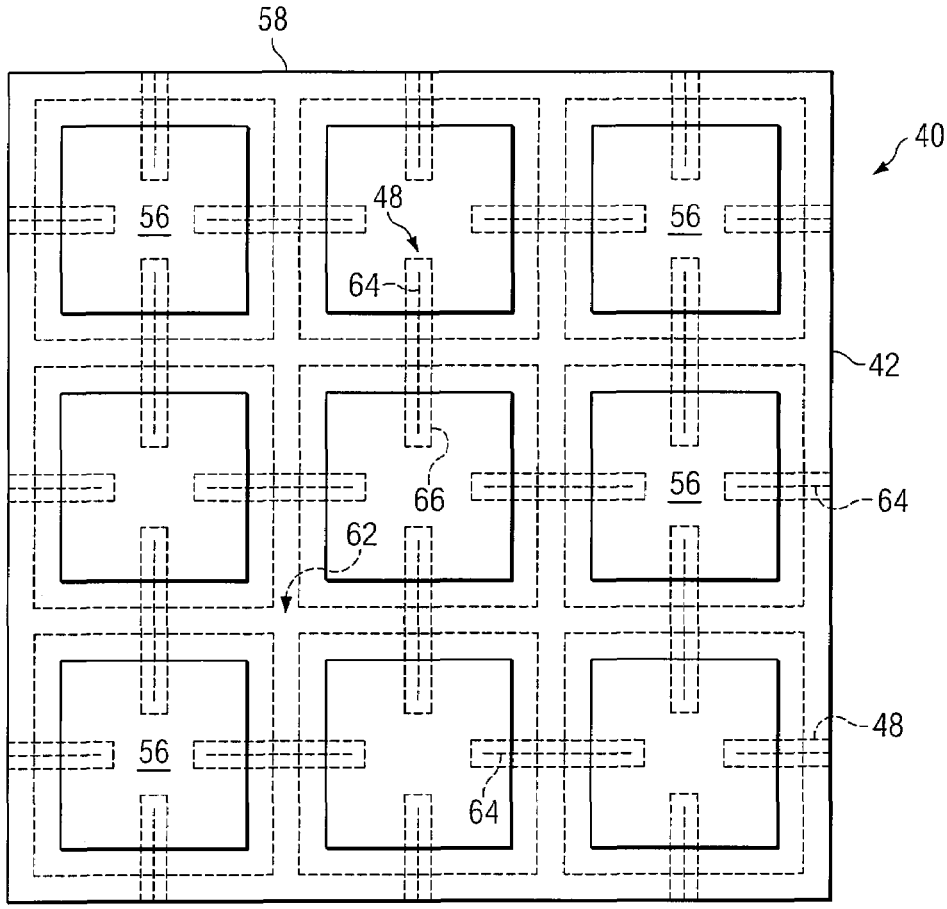
FIG. 2B is a plan view of the embodiment of FIG. 2A.
Figure 2C:
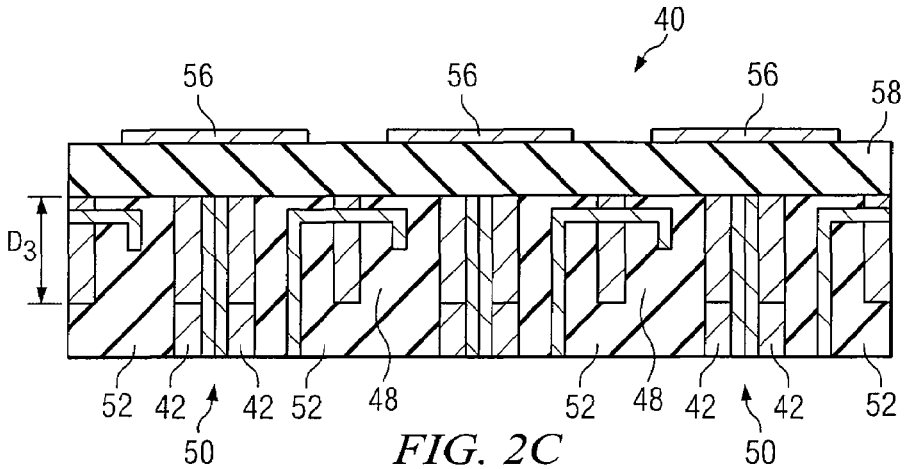
FIG. 2C is a side elevation, cross-sectional view of the embodiment of FIG. 2A.

FIGS. 2A through 2C shows another embodiment of a dual polarized low profile antenna 40 that may be configured as an array. An array is commonly referred to as a number of antennas that are configured together in order to generate a corresponding number of electro-magnetic waves that may be combined in free space in order to form a single resulting electro-magnetic wave. The dual polarized low profile antenna 40 generally includes a generally flat conductive plate 42 having a number of first channels 44 and a number of second channels 46 that may be generally orthogonal to the first channels 44. Each of the first 44 and second 46 channels form two spaced apart conductive members defining first and second active elements respectively. A number of stripline balun circuit cards 48 are disposed in slots 50 intersecting first 44 and second 46 channels. A ground plane 52 may be included such that when electrical signals are applied to the one or more stripline balun circuit cards 48, ground plane 52 causes electro-magnetic energy to be directed along a direction of propagation 54.

In operation, first active elements formed by first channels 44 may work in conjunction to form a locus of electro-magnetic waves having a first polarity, and second active elements formed by second channels 46 may work in conjunction to form a locus of electro-magnetic waves having a second polarity. By controlling the signal to second channels 46 independently of first channels 44, the resulting electro-magnetic wave emanating from the dual polarized low profile antenna 40 may have any desired polarization. In this particular embodiment, a total of two first channels 44 and a total of two second channels 46 are shown. However, it should be appreciated that any quantity of first 44 and second 46 channels may be utilized.

A parasitic element 56 is disposed a predetermined distance from each of the first 44 and second 46 channels by a dielectric layer 58. In other embodiments, multiple parasitic elements 56 may be disposed at various distances from each of the first 44 and second 46 channels. Dual polarized low profile antenna 40 also has several parasitic elements 56 that are disposed a predetermined distance from first 44 and second 46 channels by a dielectric layer 58. In a similar manner to the dual polarized low profile antenna 10 of FIGS. 1A through 1C, the depth of dielectric layer 58, material from which the dielectric layer 58 is formed, and the shape and quantity of parasitic elements 56 may be customized to match the impedance of the dual polarized low profile antenna 40 to free space. In one embodiment, the depth $D_3$ of first 44 and second 46 channels are less than ¼ wavelength at their intended operating frequency. Thus, resonance is not attained within the first 44 and/or second 46 channels themselves, but rather in conjunction with parasitic elements 56. Certain embodiments may provide an advantage in that implementation of parasitic elements 56 may provide numerous physical characteristics that may be manipulated in order to customize the operating characteristics of the dual polarized low profile antenna 40.

FIGS. 2B and 2C are plan and elevational views respectively of the dual polarized low profile antenna 40 of FIG. 2A showing the arrangement of stripline balun circuit cards 48 and parasitic elements 56 in relation to first 44 and second 46 channels. Also shown are cross-shaped regions 62 that refer to intersection points of first 44 and second 46 channels. In the particular embodiment shown, parasitic elements 56 do not cover either the first 44 and/or second 46 channels. That is, parasitic elements 56 do not extend over any portion of channels 44 and 46. Nevertheless, it should be appreciated that parasitic elements 56 that partially or fully cover first 44 or second 46 channels may be encompassed within the scope of this disclosure.

Stripline balun circuit cards 48 may be formed from a piece of printed circuit board (PCB) material in which a conductive section of stripline 64 is disposed in between two generally rigid sheets 66 of insulative material, such as fiber board. Thus, stripline balun circuit card 48 may be inductively coupled to each channel 44 or 46 that it intersects. Stripline balun circuit cards 48 may be disposed any distance from cross-shaped regions 62. In this particular embodiment, stripline balun circuit cards 48 may be centrally disposed in between adjacent cross-shaped regions 62. Stripline balun circuit cards 48 however, may be disposed at any suitable distance from cross-shaped regions 62 in order to further tailor the operating characteristics of the dual polarized low profile antenna 40.

Figure 3A:
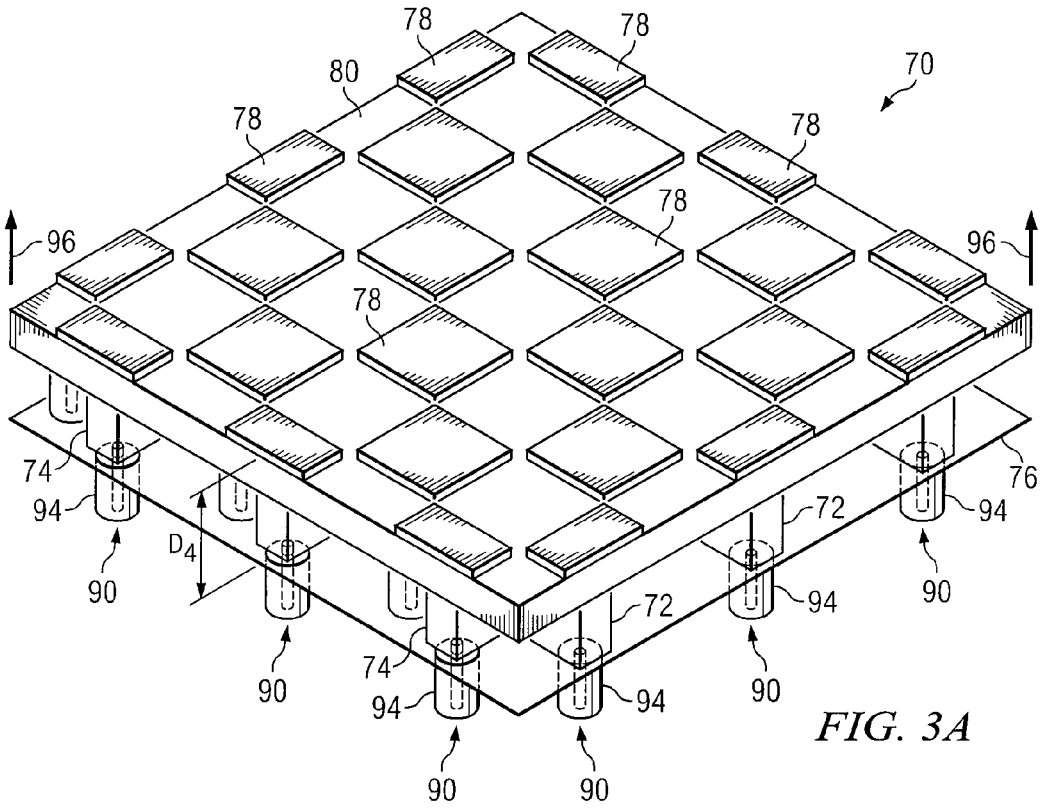
FIG. 3A is a perspective view of another embodiment according to the teachings of the disclosure.

FIG. 3A shows another embodiment of a dual polarized low profile antenna 70 according to the teachings of the present disclosure. Dual polarized low profile antenna 70 generally includes a number of first folded baluns 72 and a number of second folded baluns 74 that are configured on a generally flat ground plane 76. A number of parasitic element 78 are disposed a predetermined distance from folded baluns 72 and 74 by a dielectric layer 80. Folded baluns 72 and 74 may be operable to convert unbalanced signals to balanced signals while having a relatively short depth profile. When excited by an electrical signal from one or more unbalanced lines 90, a locus of electro-magnetic waves may be emitted having a direction of propagation 96. Thus, the dual polarized low profile antenna 70 may provide another approach of generating a locus of electro-magnetic waves using a structure having a relatively shorter depth profile $D_4$ than previously known structures.

Figure 3B:
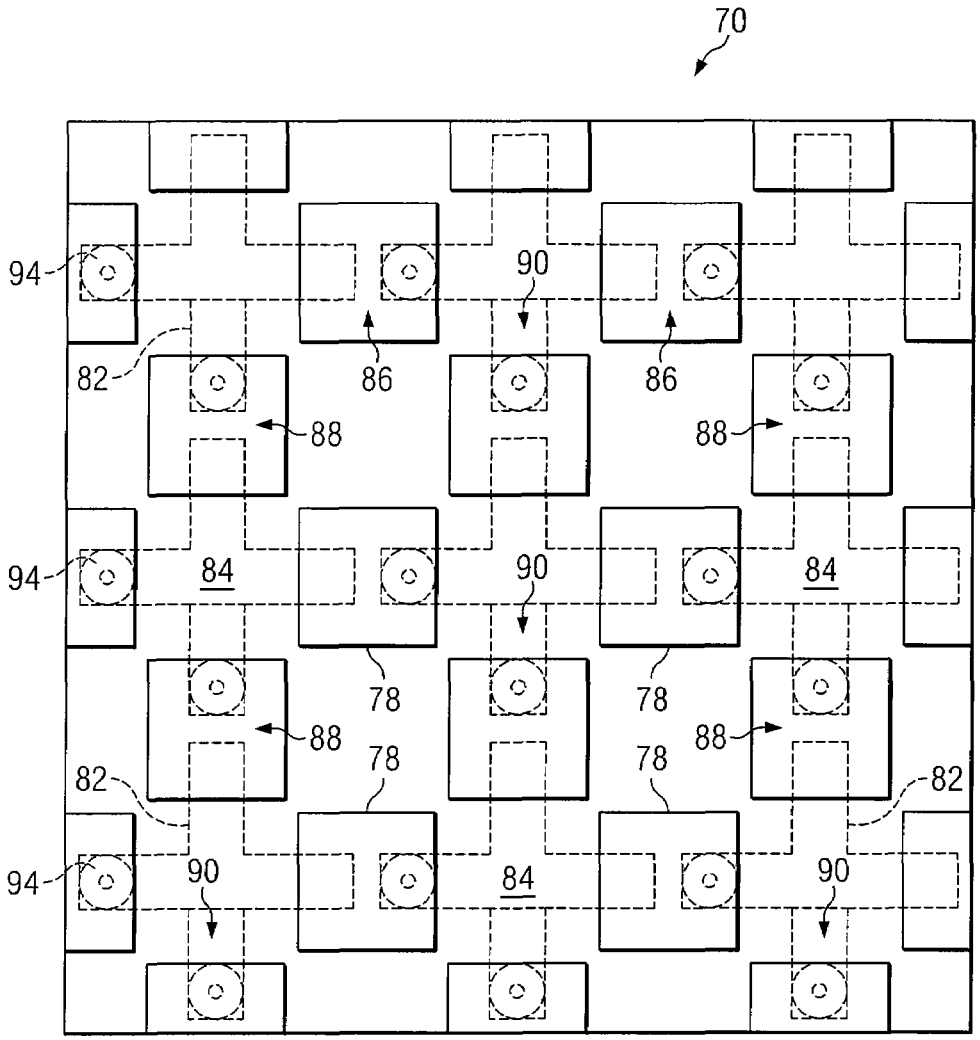
FIG. 3B is a plan view of the embodiment of FIG. 3A.
Figure 3C:
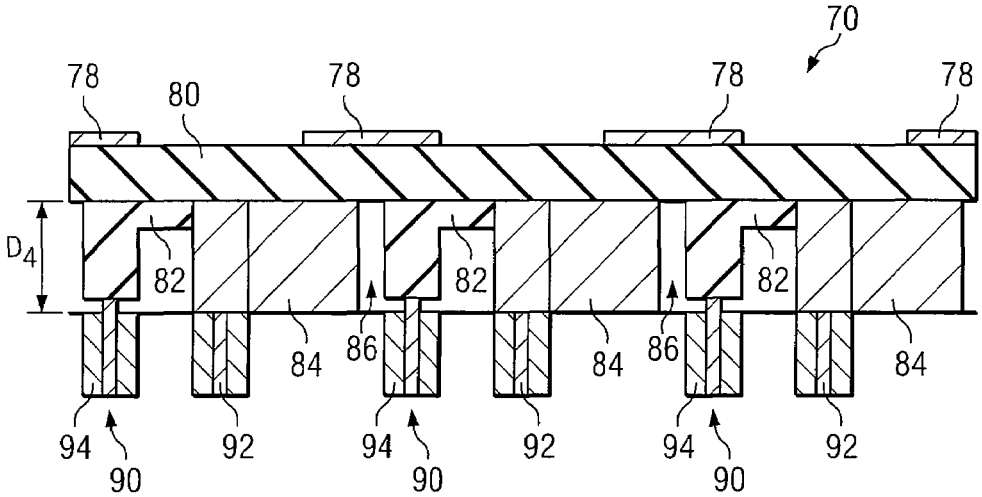
FIG. 3C is a side elevation, cross-sectional view of the embodiment of FIG. 3A.

FIGS. 3B and 3C shows plan and elevational views respectively of the dual polarized low profile antenna 70 of FIG. 3A. Folded baluns 72 and 74 may be provided in pairs such that first folded balun 72 is integrally formed with and oriented in a direction different to second folded balun 74. In one embodiment, first folded balun 72 is orthogonal to second folded balun 74.

Each of the first 72 and second 74 folded baluns has a excitation portion 82 and a ground portion 84. Excitation portion 82 may be placed adjacent a ground portion 84 of another folded balun 72 or 74 in order to form two space apart conductive members defining first 86 and second 88 active elements. A number of integrally formed first 72 and second 74 folded baluns may be similarly configured on ground plane 76 in order to form a corresponding number of first 86 and second 88 active elements.

Excitation portion 82 may be electrically connected to the center conductor 92 of unbalanced line 90, which in this embodiment is a coaxial cable. The ground portion 94 of unbalanced line 90 may be electrically connected to the a ground portion 84 of folded balun 72 or 74 through ground plane 76. As best shown in FIG. 3C, a number of unbalanced lines 90 may be provided that independently control signals to first 86 and second 88 active elements.

In a manner similar to the dual polarized low profile antenna 40 of FIGS. 2A through 2C, the shape of the parasitic elements 78 and their distance above first 86 and second 88 active elements may serve to tailor the operating characteristics of the dual polarized low profile antenna 70. Parasitic elements 78 may be disposed such that they cover active elements 86 or 88 as shown in FIG. 3C. However, parasitic elements 78 may be disposed in any suitable position over the active elements 86 or 88 in that they do not cover or only partially cover active elements 86 or 88.

Figure 4:
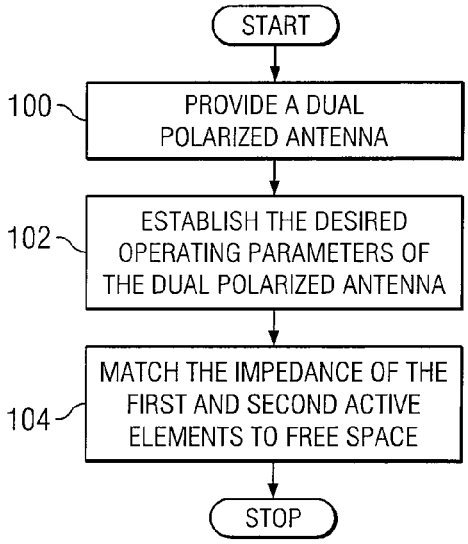
FIG. 4 is a flowchart showing one embodiment of a series of actions that may be performed to construct the dual polarized low profile antenna of FIGS. 1A, 2A, or 3A.

FIG. 4 shows a series of actions that may be performed in order to construct the dual polarized low profile antenna 10, 40, or 70. In act 100, a dual polarized low profile antenna 10, 40, or 70 may be provided according to the embodiments of FIG. 1A through 1C, 2A through 2C, or 3A through 3C respectively. Next in act 102, the desired operating parameters of the dual polarized low profile antenna 10, 40, or 70 may be established. The desired operating parameters of the dual polarized low profile antenna 10, 40, or 70 may include operating characteristics, such as a frequency of operation, a frequency bandwidth (BW), scan symmetry, and a two-dimensional scan capability. It should be appreciated however, that other operating parameters other than those described above may be tailored by the teachings of the present disclosure.

Once the desired operating parameters have been established, the impedance of the first 12, 44, or 86 and second 14, 46, or 88 active elements may be generally matched to free space over the desired bandwidth of frequencies in act 104. It should be appreciated that the act of matching the first 12, 44, or 86 and second 14, 46, or 88 active elements to free space is not intended to provide a perfect match over the entire range of desired operating bandwidth. However, the terminology "matched" is intended to indicate a level of impedance matching over the desired range of operating frequencies sufficient to allow transmission and/or reception of electro-magnetic energy from free space to the dual polarized low profile antenna 10, 40, or 70. The act of matching the first 12, 44, or 86 and second 14, 46, or 88 active elements to free space may be accomplished by selecting one or more physical characteristics of the parasitic elements 18, 56, or 78, or dielectric layer 22, 58, or 80. The physical characteristics may include selecting the size or orientation of each of the one or more parasitic elements 18, 56, or 78, selecting a depth of the dielectric layer 22, 58, or 80, selecting a dielectric constant of the material from which the dielectric layer 22, 58, or 80 is formed, the number of parasitic elements 18, 56, or 78 used, or the level in which the parasitic elements 18, 56, or 78 cover the first 12, 44, or 86 and second 14, 46, or 88 active elements. It should be understood that other physical characteristics than those disclosed may be operable to modify the operating parameters of the dual polarized low profile antenna 10, 40, or 70. However, only several physical characteristics have been disclosed for the purposes of brevity and clarity of disclosure.

Several embodiments of a dual polarized low profile antenna 10, 40, or 70 has been described that provides for dual polarization of a low profile antenna structure. Implementation of parasitic elements 18, 56, and 78 in the form of thin conductive plate structures enables tailoring of the operating characteristics of the dual polarized low profile antenna 10, 40, or 70 without adding significant depth to the overall structure. Dual polarization of the dual polarized low profile antenna 10, 40, or 70 may provide for scanning of the resulting electro-magnetic wave and/or transmission of circular polarized electro-magnetic waves. Thus, certain embodiments may provide an advantage in that scan control may be enabled for applications where the overall depth of the dual polarized low profile antenna 10, 40, or 70 is limited.

Although the present disclosure describes several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. A dual polarized antenna comprising:

first and second active elements, the first active element having a direction of polarization that is orthogonal to a direction of polarization of the second active element, the first and second active elements intersecting one another in order to form a cross-shaped region;

a balun and a ground plane coupled to each of the first and second active elements, the balun being coupled to each of the first and second active elements proximate the cross-shaped region, the balun being operable to generate electro-magnetic energy from the first and second active elements along a direction of propagation, at least one generally flat parasitic element having a surface that is disposed at a predetermined distance from the first and second active elements and normal to the direction of propagation; and a dielectric layer in between the first and second active elements and the at least one parasitic element;

wherein the at least one parasitic element and the dielectric layer match the impedance of the first and second active elements to free space.

2. A dual polarized antenna comprising:

first and second active elements each comprising two spaced apart conductive members; the first active element having a direction of polarization that is different than a direction of polarization of the second active element, the two spaced apart conductive members each comprising an excitation portion of a folded balun and a ground portion of another folded balun;

circuitry coupled to the first and second active elements, the circuitry being operable to generate electro-magnetic energy from the first and second active elements along a direction of propagation; and at least one parasitic element disposed a predetermined distance from the first and second active elements and normal to the direction of propagation;

wherein the at least one parasitic element matches the impedance of the first and second active elements to free space.

3. The dual polarized antenna of claim 2, wherein the direction of polarization of the first active element is orthogonal to the direction of polarization of the second active element.

4. The dual polarized antenna of claim 2, wherein the two spaced apart conductive members comprise conductive strips on a first layer of a printed circuit board.

5. The dual polarized antenna of claim 4, wherein the printed circuit board is a multi-layer printed circuit board, the at least one parasitic element being formed on a second layer of the multi-layer printed circuit board.

6. The dual polarized antenna of claim 5, wherein the circuitry comprises a stripline balun and a ground plane, the stripline balun being formed on a third layer of the multi-layer printed circuit board and the ground plane being formed on a fourth layer of the multi-layer printed circuit board.

7. The dual polarized antenna of claim 2, wherein the two spaced apart conductive members are formed by a channel in a conductive plate.

8. The dual polarized antenna of claim 2, wherein the first and second active elements have a length that extends normal to the direction of propagation, the first and second active elements intersecting one another in order to form a cross-shaped region, the circuitry being coupled to the first and second active elements proximate the cross-shaped region.

9. The dual polarized antenna of claim 2, wherein the first and second active elements have a length that extends normal to the direction of propagation, the first and second active elements intersecting one another in order to form a cross-shaped region, the circuitry is coupled to the first and second active elements at a predetermined distance from the cross-shaped region.

10. The dual polarized antenna of claim 2, wherein the parasitic element is a generally flat plate.

11. The dual polarized antenna of claim 2, wherein the circuitry comprises a ground plane.

12. The dual polarized antenna of claim 2, further comprising a dielectric layer in between the first and second active elements and the at least one parasitic element, wherein the at least one parasitic element and the dielectric layer match the impedance of the first and second active elements to free space.

13. The dual polarized antenna of claim 2, wherein the at least one parasitic element comprises a plurality of parasitic elements.

14. A method of constructing a dual polarized antenna comprising:

providing an antenna comprising first and second active elements each comprising two spaced apart conductive members, the first active element having a direction of polarization that is different than a direction of polarization of the second active element, the two spaced apart conductive members each comprising an excitation portion of a folded balun and a ground portion of another folded balun, circuitry coupled to the first and second active elements, the circuitry being operable to generate electro-magnetic energy from the first and second active elements along a direction of propagation, and at least one parasitic element having a surface disposed a predetermined distance from the first and second active elements and normal to the direction of propagation;

determining the desired operating parameters of the dual polarized antenna; and matching the impedance of the first and second active elements to free space.

15. The method of claim 14, wherein matching the impedance of the first and second active elements to free space further comprises selecting a size of the at least one parasitic element.

16. The method of claim 14, wherein matching the impedance of the first and second active elements to free space further comprises selecting a depth of a dielectric layer disposed between the first and second active elements and the at least one parasitic element.

17. The method of claim 14, wherein matching the impedance of the first and second active elements to free space further comprises selecting a dielectric constant of a material from which a dielectric layer disposed between the first and second active elements and the at least one parasitic element is formed.

18. The method of claim 14, wherein matching the impedance of the first and second active elements to free space further comprises selecting a quantity of the at least one parasitic element.

19. The method of claim 14, wherein matching the impedance of the first and second active elements to free space further comprises selecting a level in which the at least one parasitic element covers the first and second active elements.

* * * * *